US010945056B2

(12) United States Patent
Charriere et al.

(10) Patent No.: US 10,945,056 B2
(45) Date of Patent: Mar. 9, 2021

(54) MICROPHONE ASSEMBLY

(71) Applicant: Sonova AG, Staefa (CH)

(72) Inventors: Fabrice Charriere, Granges-Paccot (CH); Marc Herren, Murten (CH); Samuel Harsch, Ligniéres (CH)

(73) Assignee: Sonova AG, Staefa (CH)

( * ) Notice: Subject to any disclaimer, the term of this patent is extended or adjusted under 35 U.S.C. 154(b) by 225 days.

(21) Appl. No.: 15/768,062

(22) PCT Filed: Oct. 27, 2015

(86) PCT No.: PCT/EP2015/074853
§ 371 (c)(1),
(2) Date: Apr. 13, 2018

(87) PCT Pub. No.: WO2017/071738
PCT Pub. Date: May 4, 2017

(65) Prior Publication Data

US 2020/0213689 A1 Jul. 2, 2020

(51) Int. Cl.
*H04R 1/08* (2006.01)
*H04R 1/02* (2006.01)
(Continued)

(52) U.S. Cl.
CPC ..... *H04R 1/02* (2013.01); *H04R 1/04* (2013.01); *H04R 1/08* (2013.01); *H04R 1/086* (2013.01);
(Continued)

(58) Field of Classification Search
CPC . H04R 1/04; H04R 1/08; H04R 1/083; H04R 1/086; H04R 1/342; H04R 1/406; H04R 2420/07
(Continued)

(56) References Cited

U.S. PATENT DOCUMENTS 5,706,359 A * 1/1998 Chang ..... H04R 1/08 381/355
6,285,772 B1 * 9/2001 Tate ..... H04R 1/406 379/433.03
(Continued)

FOREIGN PATENT DOCUMENTS

WO 200106811 A1 1/2001

OTHER PUBLICATIONS

International Search report and Written Opinion; International Application PCT/EP2015/074853; Applicant Sonova AG; filed Oct. 27, 2015, dated Jul. 18, 2016, 11 pages.

*Primary Examiner* — Huyen D Le
(74) *Attorney, Agent, or Firm* — ALG Intellectual Property, LLC

(57) ABSTRACT

There is provided a microphone assembly, comprising a base body portion comprising a top plate at its distal end; and a dome portion mounted at the distal end of the base body portion and having a perforated structure with at least 50% of outwardly facing surface area of the dome portion being formed by open areas, the dome portion made of a plastic material; at least one microphone capsule located within the dome portion, and an RF antenna located within the dome portion, the top plate comprising a reflection cone pointing towards the dome portion in order to reflect sound axially impinging on the reflection cone radially outwardly.

19 Claims, 7 Drawing Sheets

(51) Int. Cl.
*H04R 1/34* (2006.01)
*H04R 1/40* (2006.01)
*H04R 1/04* (2006.01)

(52) U.S. Cl.
CPC ..... *H04R 1/342* (2013.01); *H04R 1/406* (2013.01); *H04R 2420/07* (2013.01)

(58) Field of Classification Search
USPC ..... 381/355, 359, 360, 361, 362, 363; 379/433.03
See application file for complete search history.

(56) References Cited

U.S. PATENT DOCUMENTS 7,974,429 B2 * 7/2011 Tsai ..... H04R 1/08 381/355
2003/0011820 A1 6/2003 Kawasaki

* cited by examiner

SECTION A-A

MICROPHONE ASSEMBLY

The invention relates to a microphone assembly comprising a base body portion comprising a top plate at its distal end; and a dome portion mounted at the distal end of the base body portion and comprising at least one microphone capsule.

Such microphone assembly may form part of a wireless acoustic system; for example, the output audio signal of the microphone assembly may be transmitted to hearing aids worn by hearing impaired students in a class room.

For hearing impaired people speech understanding in noise and/or over larger distance is a serious challenge. In such cases, the use of a wireless microphone that picks up the speaker's voice close to its source, i.e. close to the speaker's mouth, is very helpful, since a hearing aid on its own may not be able to provide the signal-to-noise ratio required for speech understanding by the wearer of the hearing aid.

In general, the purpose of a wireless microphone is to improve the signal-to-noise ratio of speech of a distant speaker in a noisy and/or reverberant environment. For this purpose, the wireless microphone assembly has to be placed close to the speaker's mouth. Further, wireless microphone assemblies typically have a certain directivity allowing to further attenuate environmental noise with regard to the desired speech.

Typically, the dome portion is formed by a metal grid for protecting the microphone capsule; such grid prevents the intrusion of objects which might impact the microphone capsule, and it also protects the microphone capsule in case of shocks.

An example of such microphone is shown in GB 2 223 145 A.

A wireless microphone assembly includes an RF (radio frequency) antenna which, in case of a metal grid forming the dome, cannot be placed inside the dome and therefore typically is placed at the bottom of the microphone assembly. However, if the user puts his/her hand on the area at the bottom of the microphone where the antenna is placed, this will significantly degrade the performance of the antenna.

It is an object of the invention to provide for a wireless microphone assembly, wherein the microphone capsule(s) are well protected, while allowing for reliable RF antenna performance and for high audio signal quality.

According to the invention, this object is achieved by a microphone assembly as defined in claim 1.

The invention is beneficial in that, by providing a dome portion mounted at the distal end of the base body portion having a perforated structure with at least 50% of its outwardly facing surface area being formed by open areas and being made of a plastic material, it is possible to place the RF antenna within the dome portion, so that it will not interfere with a hand of the user holding the microphone assembly at the base body portion; the open areas of the dome portion allow air vibrations to be transmitted through the dome, thereby providing for high sound quality. The sound quality is further enhanced by a reflection cone of the top plate of the base body portion, which cone points towards the dome portion in order to reflect sound axially impinging on the reflection cone radially outwardly, thereby reducing unwanted reflections.

Preferably, the dome portion comprises an outer dome and an inner dome nested inside the outer dome at a radial distance, the inner dome and the outer dome being made of the plastic material and comprising a plurality of parallel radially extending pillars, wherein the pillars of the inner dome are located at an angular off-set with regard to the pillars of the outer dome in a manner so that the pillars of the inner dome are located in-between adjacent pillars of the outer dome, when seen in a radial direction. Thereby it is possible to place the RF antenna within the inner dome, while objects which may pass through the pillars of the outer dome will be blocked by the pillars of the inner dome, thereby providing for a good protection of the microphone capsule(s). The spacing between the inner dome and the outer dome allows air vibrations to be transmitted through the dome, and the double dome structure causes an acceptable vibration damping from an acoustic point of view, thereby providing for high sound quality.

Further preferred embodiments of the invention are defined in the dependent claims.

Hereinafter, an example of the invention will be illustrated by reference to the attached drawings, wherein.

Figure 1:
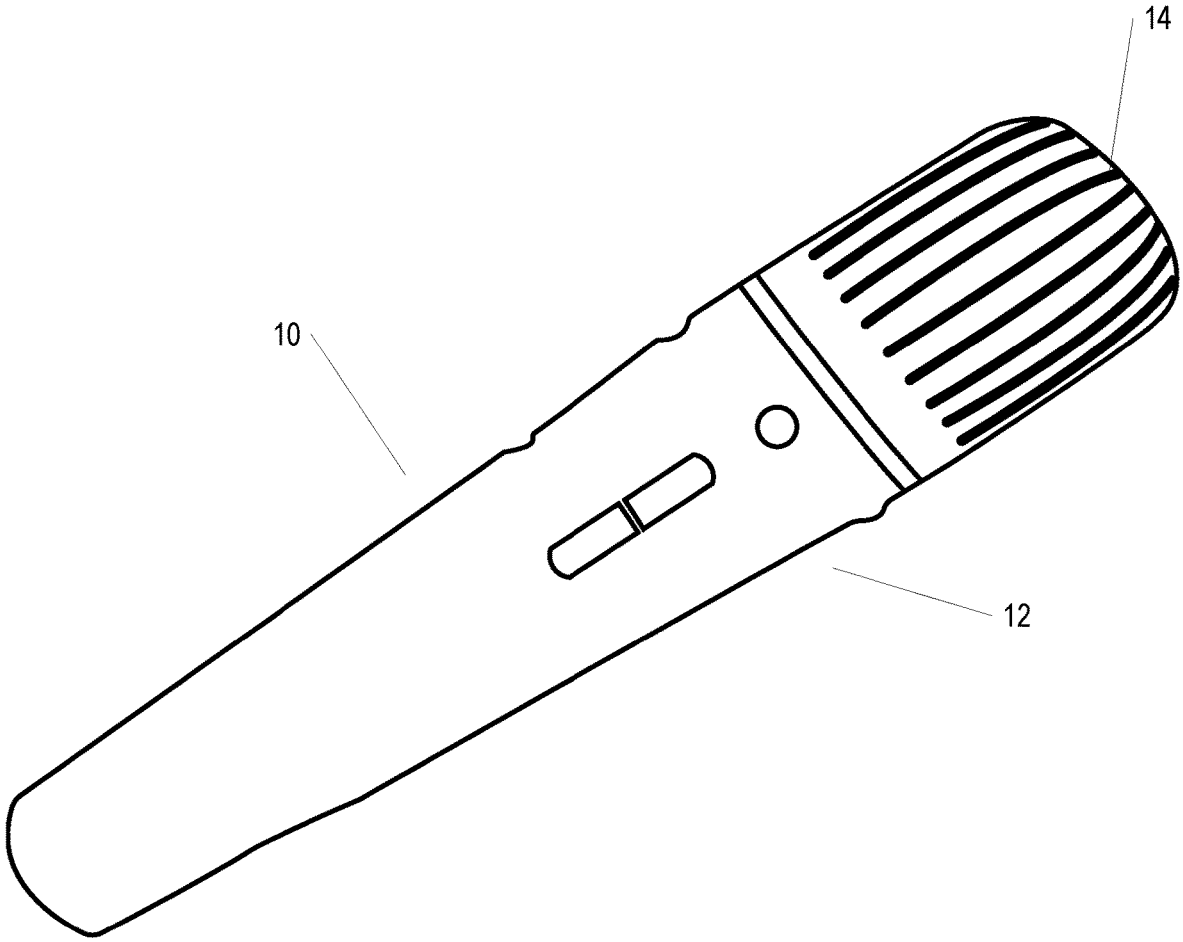
FIG. 1 is a perspective view of an example of a microphone assembly according to the invention.

An example of a microphone assembly 10 according to the invention is shown as a perspective view in FIG. 1. The microphone assembly 10 comprises a base body portion 12 and a dome portion 14 mounted at the distal end of the base body portion 12. For example, the proximal end of the base body portion 12 may be mounted in a microphone table stand for being placed on a table. Alternatively, the speaker may take the base body portion 12 in one hand when using the microphone assembly 10.

Figure 2:
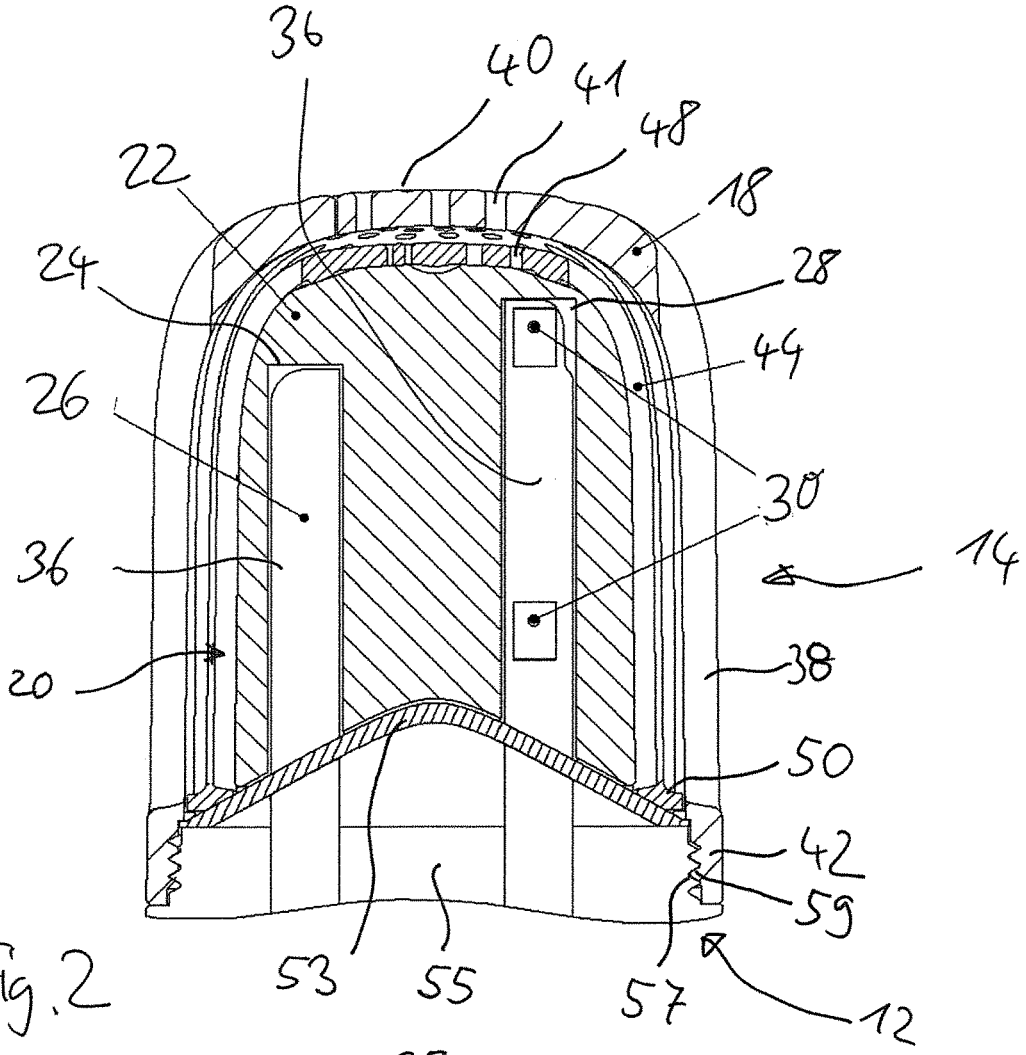
FIG. 2 is a longitudinal cross-sectional view of the dome portion and the top plate of the microphone assembly of FIG. 1.
Figure 4:
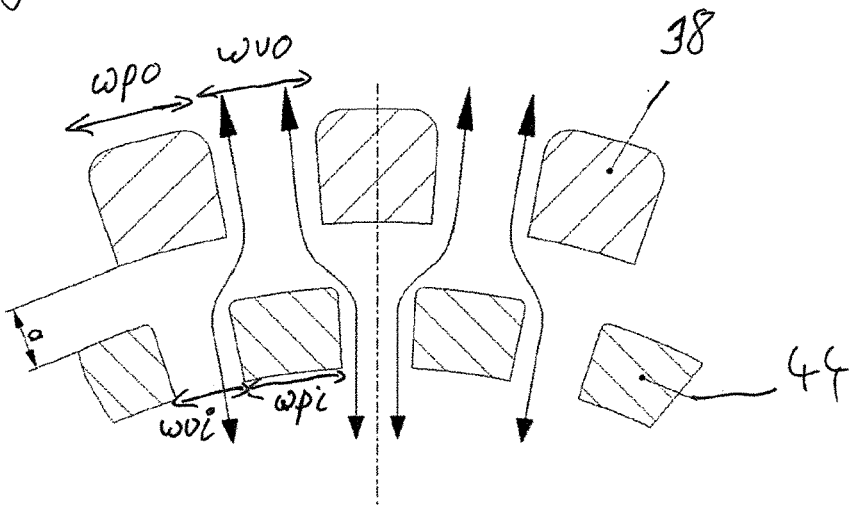
FIG. 4 is an enlarged portion of the area indicated at "B" in FIG. 3B, with the air flow being indicated by arrows.

A longitudinal cross-sectional view of the dome portion 14 is shown in FIG. 2, according to which the dome portion 14 comprises an outer dome 18 and an inner dome 20 nested inside the outer dome 18 at a radial distance a (see FIG. 4). A foam body 22 with open porosity is located within the inner dome 20 in a manner so as to fill the interior space defined by the inner dome 20; the foam body may be made of polyester. The foam body 22 comprises a first receptacle 24 for receiving an RF antenna 26 and a second receptacle 28 for receiving two axially spaced apart microphone capsules 30. The microphone capsules 30 are arranged axially in line for enabling acoustic beam forming. The RF antenna 26 extends along the axial direction. As shown schematically in FIG. 10, the microphone assembly 10 comprises an audio signal processing unit 32 for processing the audio signals captured by the microphone capsules 30 in a manner so as to provide for acoustic beam forming; the processed audio signal is supplied to a transmitter 34 for transmitting the processed audio signal via the antenna 26 over a wireless link 60 to a receiver unit 62 of a hearing instrument 64 (see FIG. 9) or a speech enhancement system (see FIG. 10).

The RF antenna 26 and the microphone capsules 30 are carried by supports 36, as shown in FIG. 2.

Figure 3A:
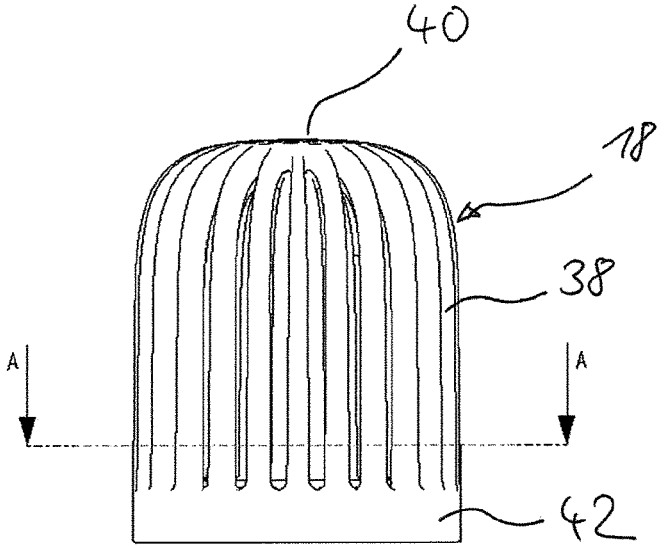
FIGS. 3A and 3B are a side view of the dome portion of the microphone assembly of FIG. 1 and a cross-sectional view of the inner and outer dome of FIG. 3A seen in the direction of the arrow A, respectively.

Both the inner dome 20 and the outer dome 18 are made of plastic material so as to not compromise operation of the RF antenna 26; the plastic material may be, for example, a polyamide (PA), a polyoxymethylene (POM), an acrylonitrile-butadiene-styrene (ABS) or a polycarbonate (PC), or mixtures thereof. The structure of the inner dome 20 and the outer dome 18 is shown in more detail in FIGS. 3, 4 and 8. The outer dome 18 comprises a plurality of parallel radially extending pillars 38 which are arranged on a circle. The outer dome 18 comprises a proximal portion in which the pillars 38 define a cylindrical surface and a distal portion in which the pillars 38 converge towards each other (i.e. towards a center point) so as to define a cup-shaped distal end surface 40 which comprises a plurality of sound entrance openings 41 (see FIG. 2). The proximal end portion of the outer dome 18 is formed by a cylindrical wall portion 42 from which the pillars 38 extend in the axial direction towards the distal end surface 40. The ratio of the width wpo of the pillars 38 and the width wvo of the voids between adjacent pillars 38 of the outer dome, as seen in a peripheral direction, i.e. wpo wvo, preferably is f is not more than 1.

The inner dome 20 has a geometric structure which is similar to that of the outer dome 18, i.e. it comprises a plurality of parallel radially extending pillars 44 which define in a proximal portion of the inner dome 20 a cylindrical surface and which converge in a distal portion of the inner dome 20 towards a center point so as to define a cup-shaped distal end surface 46 comprising a plurality of sound entrance openings 48; the proximal end portion of the inner dome 20 is formed by a cylindrical wall portion 50 from which the pillars 44 extend in the axial direction towards the distal end surface 46. The ratio of the width wpi of the pillars 44 of the inner dome 20 and the width of the voids wvi between adjacent pillars 44 of the inner dome 20, when seen in a peripheral direction, i.e. wpi/wvi, preferably is not more than 1.

Figure 3B:
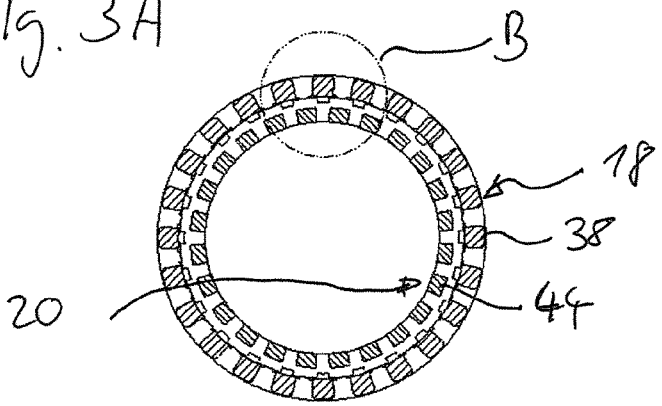

As can be seen in FIGS. 3B and 4, the inner dome 20 is arranged with regard to the outer dome 18 in a manner so that the pillars 44 of the inner dome 20 are located in-between adjacent pillars 38 of the outer dome 44, when seen in a radial direction. Thereby, sufficient protection of the interior of the inner dome 20 is achieved, since objects which may pass through the voids of the outer dome 18 will be blocked by the respective pillars 44 of the inner dome 20 located behind the voids of the outer dome 18. The spacing a between the inner dome 20 and the outer dome 18 allows air vibrations to be transmitted into the interior of the inner dome 20; further, the "double dome" structure keeps the acoustic damping (vibration damping) sufficiently low. The foam body 22 protects the microphone capsules 30 and the antenna 26 from moisture and provides for a "finished" appearance of the dome portion 14; further, the foam body 22 serves to damp acoustic resonances within the inner space formed by the inner dome 20.

Preferably, the outer dome 18 and the inner dome 20 have the same number of pillars 38, 44 the angular of the pillars 44 of the inner dome 20 with regard to the pillars 38 of the outer dome 18 equals 360 degrees divided by twice the number of the pillars; in the present example there are 24 pillars so that the angular offset is 7.5 degrees.

FIGS. 8A to 8E show how the inner dome 20 may be mounted to the outer dome 18.

Figure 8A:
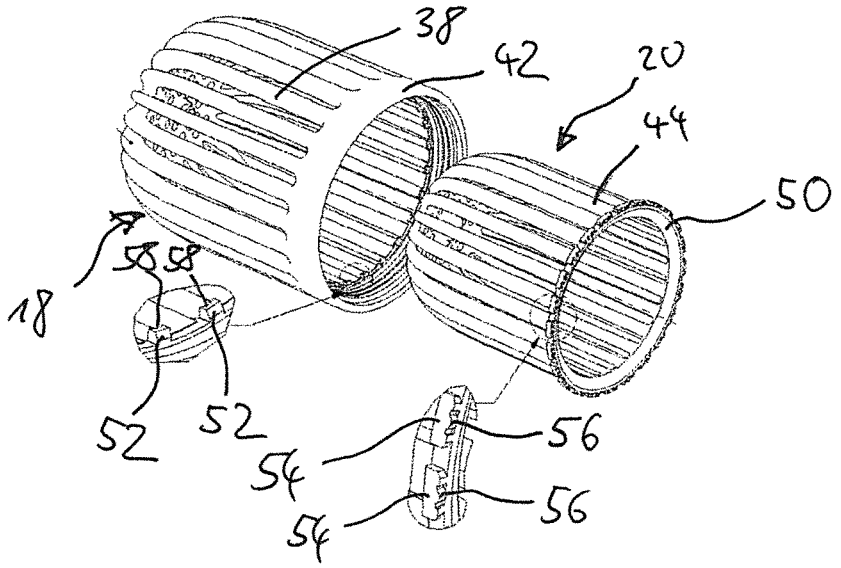
FIGS. 8A to 8E are perspective views of the inner and outer dome of the microphone assembly of FIGS. 1 and 2 during assembly.

In FIG. 8A the outer dome 18 and the inner dome 20 are shown prior to assembly; the outer dome 18 and the inner dome 20 are provided at their proximal end portions 42, 50 with mating snap-in elements 52 and 54, respectively, in order to fix the inner dome 20 to the outer dome 18 by snap-in engagement. The snap-in elements 52, 54 are provided as radially projecting elements which are regularly distributed on a peripheral circle. The snap-in elements 52 of the outer dome 18 are spaced such that a snap-in element 54 of the inner dome 54 is able to axially pass between two adjacent snap-in elements 52 of the outer dome 18 when the inner dome 20 is axially advanced into the outer dome 18. In the example shown in FIGS. 8A to 8E the snap-in elements of the outer dome project radially inwardly, whereas the snap-in elements 54 of the inner dome 20 project radially outwardly.

As shown in FIG. 8A, the proximal end of the snap-in elements 54 of the inner dome 20 is provided with a nose 56, while the distal end of the snap-in elements 52 of the outer dome 18 is provided with a receptacle 58 for receiving the nose 56 of the snap-in elements 54 of the inner dome 20, as will be explained in more detail below.

Figure 8B:
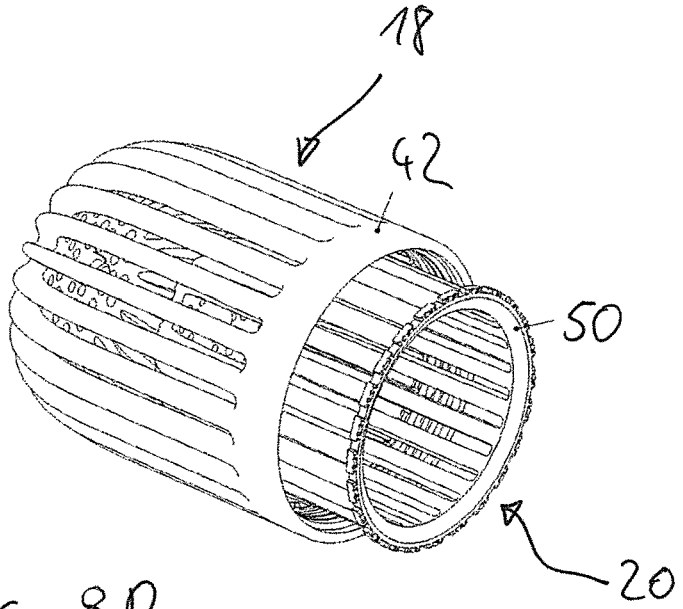
Figure 8C:
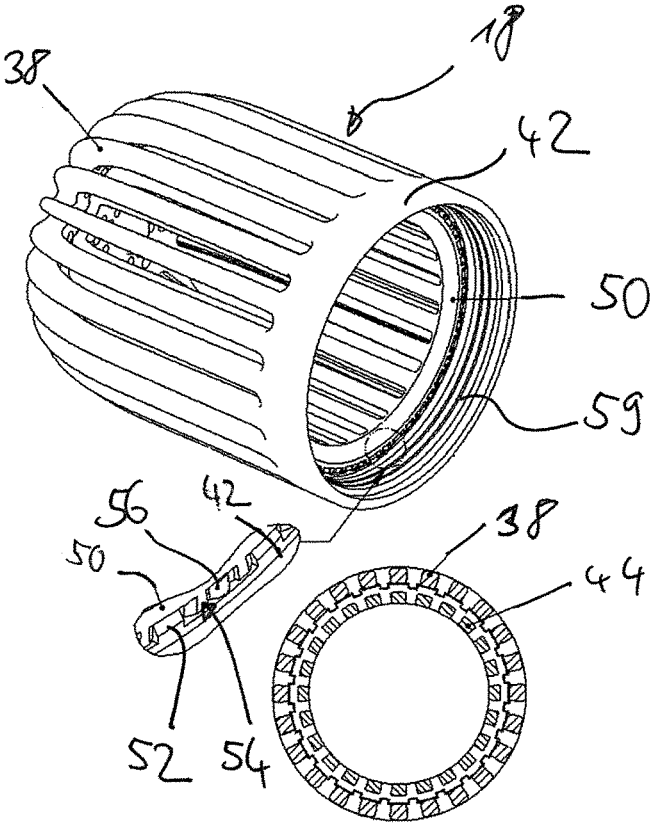
Figure 8D:
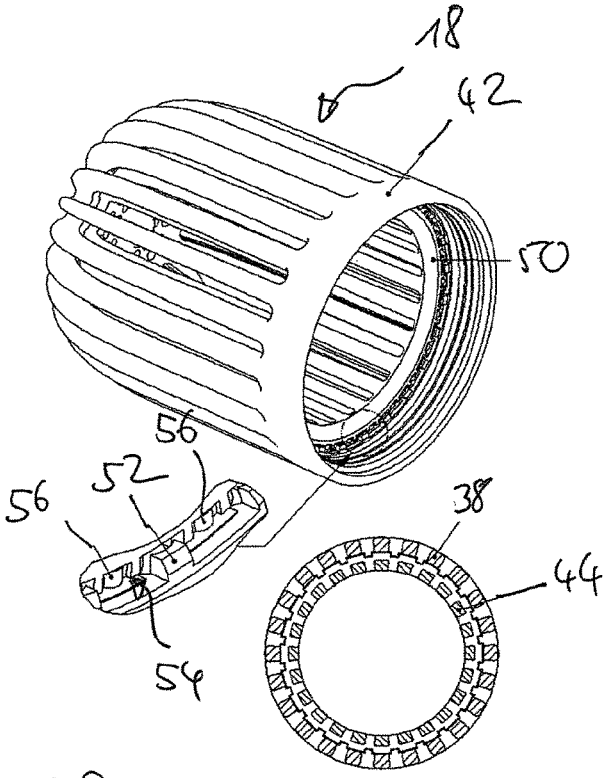

According to FIG. 8B, the inner dome 20 is pushed into the outer dome 18 in the axial direction, with the snap-in elements 54 of the inner dome 20 passing through the snap-in elements 52 of the outer dome 18, as can be seen in FIG. 8C.

Figure 8E:
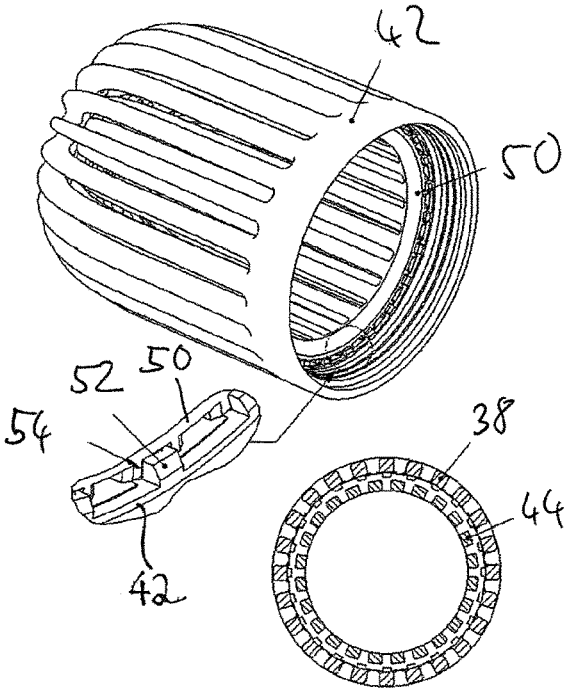

Once the snap-in elements 54 have completely passed through the voids between the snap-in elements 52, the inner dome 20 is rotated relative to the outer dome 18 (see FIG. 8D) until the noses 56 of the snap-in elements 54 engage with the respective receptacles 58 of the snap-in elements 52, see FIG. 8E. Preferably, the number of snap-in elements 52, 54 corresponds to the number of pillars 38, 44, respectively; in this case, the inner dome 20 has to be rotated by an angle of 360 degrees divided by twice the number of pillars 38 or 44 in order to bring the nose 56 of snap-in element 54 into engagement with the receptacle 58 of the adjacent snap-in element 52. The noses 56 then are kept in the respective receptacles 58 by axially acting elastic forces in the outer dome 18 and the inner dome 20, respectively.

The antenna 26 and the microphone capsules 30 are mounted, via the supports 36, to the base body portion 12, together with the foam body 22, whereupon the outer dome 18, together with the inner dome 20 fixed thereto, is attached to the distal end of the base body portion 12, typically via thread engagement. To this end, the proximal end portion 42 of the outer dome 18 is provided with an inner thread 59 which is screwed onto an outer thread 57 provided at the top plate 55 of the base body portion 12.

Figure 5:
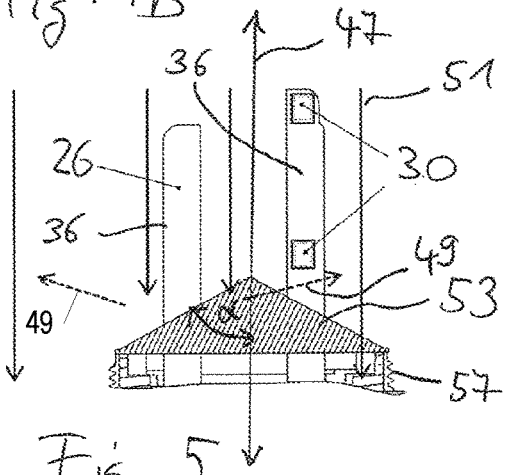
FIG. 5 is a schematic view similar to part of FIG. 2, wherein the function of the conical top plate is illustrated.

As shown in FIGS. 2 and 5, the top plate 55 of the base body portion 12 comprises a reflection cone 53 pointing towards the dome portion 14 in order to reflect sound 51 axially impinging on the reflection cone 53 radially outwardly (the reflected sound is indicated in FIG. 5 by the dashed arrows 49). Preferably, the angle $\alpha$ formed by the surface of the reflection cone 53 is from 80 to 130 degrees with regard to the axial direction 47).

As already mentioned above, the two microphone capsules 30 are used for acoustic beamforming in the audio signal processing unit 32 by appropriate signal processing. In particular, the acoustic beamforming can be used to direct the acoustic beam towards a target sound source, such as a speaking person, according to the evaluated direction of arrival of sound from the target sound source, thereby enhancing the signal-to-noise ratio. The algorithms for calculating the beamformer and the direction of arrival of the sound are mainly based on the phase difference of the audio signals captured by the two microphone capsules 30 and the physical distance between the two microphone capsules 30. The presence of a mechanical component in the proximity of the microphone capsules 30 introduces acoustic reflections and resonances. This has the effect of introducing phase mismatch compared to the ideal case (which would be the two microphone capsules alone in free space). For obtaining proper functioning of the beamformer, such phase mismatch should be as small as possible.

The main reason for phase mismatch in a typical handheld microphone assembly are acoustic reflections at the top plate of the base body portion and acoustic resonances within the dome portion. The design of the microphone assembly 10 as described above reduces the phase mismatch by the following measures: (1) the reflection cone 53 directs reflections of the incoming sound out of the domes 18, 20; (2) the domes 18, 20 have a relatively open design due to the pillars 38, 44, while the angular offset of said of the pillars 44 of the inner dome 20 with regard to the pillars 38 of the outer dome 18 prevents objects from reaching the interior of the inner dome 20; and (3) the foam body 22 filling the interior of the inner dome 20 acts to damp acoustic resonances within the inner dome 20.

Figure 7A:
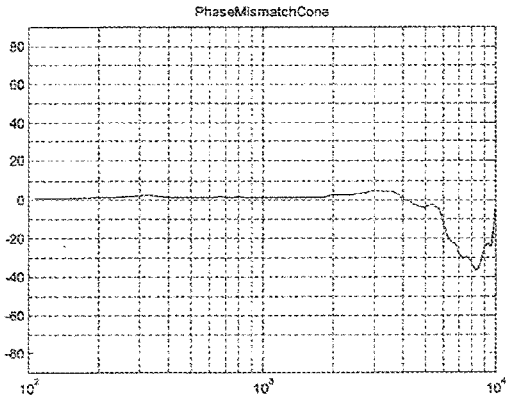
FIGS. 7A and 7B are diagrams of the phase mismatch as a function of frequency of the microphone assembly of FIG. 5 and the prior art microphone assembly of FIG. 6, respectively.
Figure 7B:
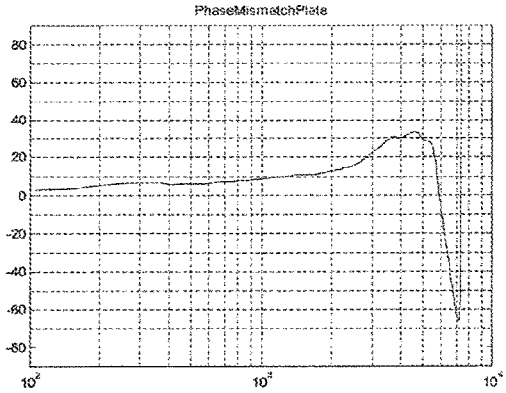
Figure 6:
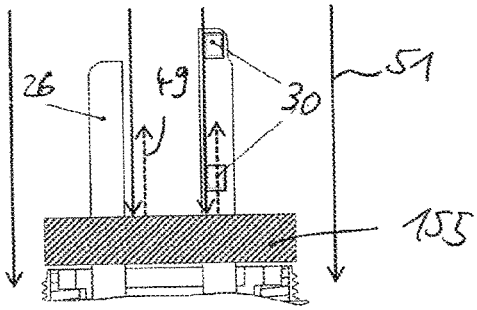
FIG. 6 is a view like FIG. 5, wherein, however, a prior art microphone assembly is shown.

In FIGS. 7A and 7B a comparison of the phase mismatch of the arrangement of FIG. 5 having a reflection cone 53 and the prior art arrangement of FIG. 6 having a flat top plate 155 is shown, according to which the reflection cone 53 serves to significantly reduce the phase mismatch at higher frequencies.

It is to be mentioned that audio signal processing in the audio signal processing unit 34 may include not only acoustic beamforming but also, for example, pre-amplification, equalizing, feedback cancelling, and automatic gain control.

As already mentioned above, the microphone assembly 10 is designed as an audio signal transmission unit for transmitting its audio signal output via a wireless link to at least one audio signal receiver unit. According to one example, the wireless microphone assembly may form part of a wireless hearing assistance system, wherein the audio signal receiver units are body-worn or ear level devices which supply the received audio signal to a hearing aid or other ear level hearing stimulation device. In particular, the microphone assembly 10 may be used as a pass-around microphone used within a group of hearing-impaired persons, such a as pupils in a class-room.

According to another example, the wireless microphone assembly may form part of a speech enhancement system in a room.

Figure 9:
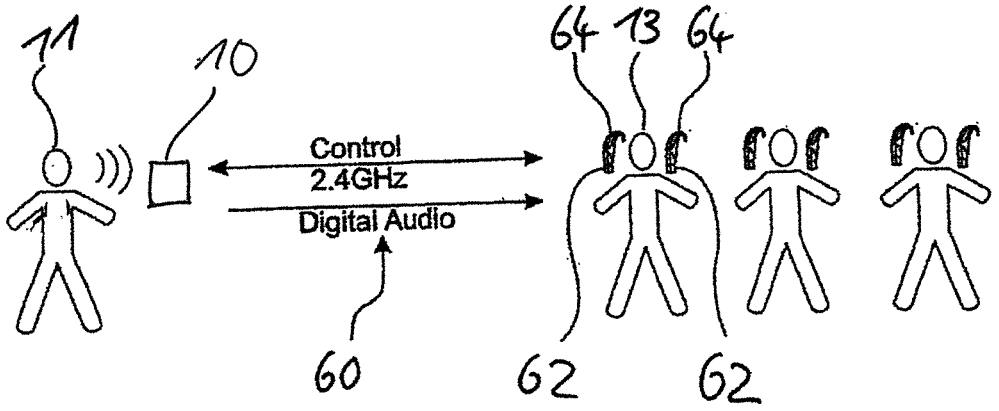
FIG. 9 is an example of a use of a wireless hearing assistance system using a microphone assembly according to the invention.

In FIG. 9 an example of a use case of as wireless hearing assistance system is shown schematically, wherein the microphone assembly 10 acts as a transmission unit which is used, for example, by a teacher 11 in a classroom for transmitting audio signals corresponding to the teacher's voice via a digital link 60 to a plurality of receiver units 62, which are integrated within or connected to hearing aids 64 worn by hearing-impaired pupils/students 13. The digital link 60 is also used to exchange control data between the microphone arrangement 10 and the receiver units 62. Typically, the microphone arrangement 10 is used in a broadcast mode, i.e. the same signals are sent to all receiver units 62.

Figure 10:
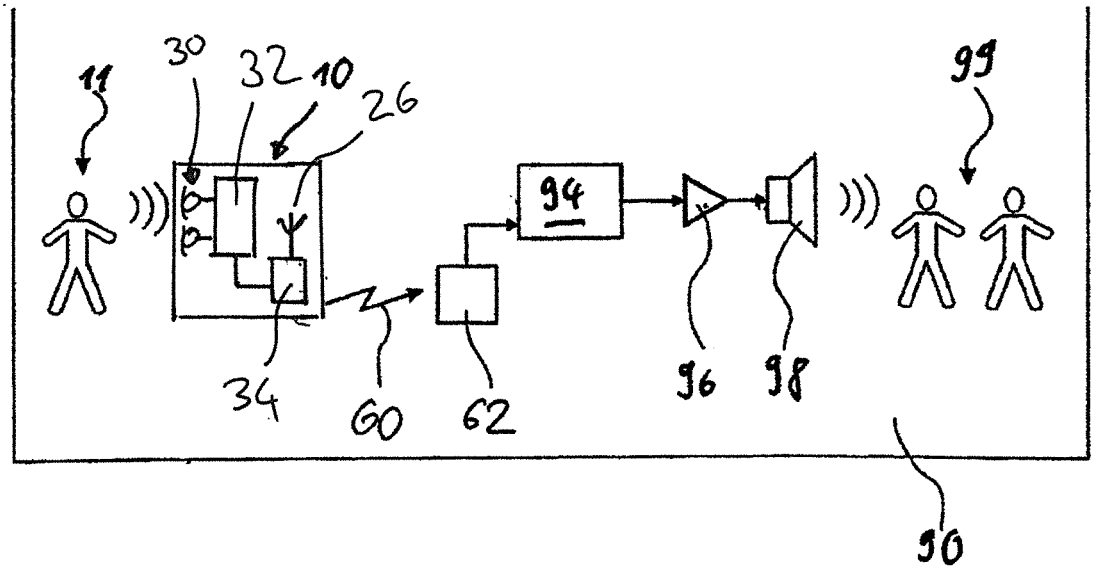
FIG. 10 is a block diagram of a speech enhancement system using a microphone assembly according to the invention.

In FIG. 10 an example of a system for enhancement of speech in a room 90 is schematically shown. The system comprises a microphone assembly 10 for capturing audio signals from the voice of a speaker 11 and generating a corresponding processed output audio signal. The microphone assembly 10 includes a transmitter or transceiver 34 for establishing a wireless audio link 60. The output audio signals are supplied via an audio signal receiver 62 to an audio signal processing unit 94 for processing the audio signals, in particular in order to apply a spectral filtering and gain control to the audio signals (alternatively, such audio signal processing, or at least part thereof, could take place in the microphone assembly 10). The processed audio signals are supplied to a power amplifier 96 operating at constant gain or at an adaptive gain (preferably dependent on the ambient noise level) in order to supply amplified audio signals to a loudspeaker arrangement 98 in order to generate amplified sound according to the processed audio signals, which sound is perceived by listeners 99.

The invention claimed is:

1. A microphone assembly, comprising:
a base body portion with a top plate at its distal end; and
a dome portion mounted at the distal end of the base body portion,
wherein the dome portion is perforated,
wherein the dome portion includes plastic material, and
wherein the dome portion further comprises:
a microphone capsule located within the dome portion, and
an radio frequency (RF) antenna located within the dome portion,
wherein the top plate comprises a reflection cone,
wherein the reflection cone is configured to reflect sound,
wherein the dome portion comprises an outer dome and an inner dome inside the outer dome, wherein the inner dome and the outer dome each comprise the plastic material and each have an axial direction and a radial direction and each comprise a plurality of parallel radially extending pillars, wherein the pillars of the inner dome are located at an angular off-set with regard to the pillars of the outer dome, and wherein the microphone capsule and the RF antenna are located within the inner dome portion.

2. The microphone assembly of claim 1, wherein the dome portion comprises a foam body with open porosity located within the inner dome.

3. The microphone assembly of claim 2, wherein the foam body fills the inner dome, with the microphone capsule and the RF antenna are disposed in receptacles of the foam body.

4. The microphone assembly of claim 1, wherein the outer dome has the same number of pillars as the inner dome.

5. The microphone assembly of claim 1, wherein the pillars of the outer dome are arranged on an outer circle, and the pillars of the inner dome are arranged on an inner circle concentric to the outer circle.

6. The microphone assembly of claim 1, wherein a ratio of a width of the pillars of the outer dome and a width of the voids between adjacent pillars of the outer dome with regard to a peripheral direction is not more than 1.

7. The microphone assembly of claim 1, wherein a ratio of the width of the pillars of the inner dome and the width of the voids between adjacent pillars of the inner dome with regard to a peripheral direction is not more than 1.

8. The microphone assembly of claim 1, wherein the outer dome and the inner dome each comprises a proximal portion in which the pillars define a cylindrical surface and a distal portion in which the pillars converge towards a center point in order to define a cup-shaped distal end surface.

9. The microphone assembly of claim 1, wherein a proximal end portion of both the outer dome and the inner dome is formed by a cylindrical wall portion from which the pillars of both the outer dome and the inner dome extend in the axial direction towards the distal portion.

10. The microphone assembly of claim 1, wherein the inner dome is fixed at the outer dome by engagement of mating snap-in elements provided at the proximal end portion of the inner dome and the outer dome, respectively.

11. The microphone assembly of claim 10, wherein the snap-in elements are radially projecting elements.

12. The microphone assembly of claim 10, wherein adjacent snap-in elements of the outer dome are spaced such one of the snap-in elements of the inner dome is able to axially pass between two adjacent snap-in elements of the outer dome.

13. The microphone assembly of claim 10, wherein the snap-in elements of the inner dome and the outer dome engage by axially acting elastic forces.

14. The microphone assembly of claim 1, wherein an angle formed by a surface of the reflection cone is from 80 to 130 degrees.

15. The microphone assembly of claim 1, wherein the base body portion is detectable from the dome portion.

16. A method of manufacturing a microphone assembly, comprising:

inserting an inner dome into an outer dome;

rotating the inner dome and the outer dome relative to each other;

positioning the inner dome and the outer dome with snap-in elements at proximal end portions of the inner dome and the outer dome; and fixing the proximal end portion of the outer dome at a distal end of a base body portion;

wherein the inner dome and the outer dome each comprise a plurality of parallel radially extending pillars, wherein the pillars of the inner dome are located at an angular off-set with regard to the pillars of the outer dome, and wherein a microphone capsule and an RF antenna are located within the inner dome portion.

17. The method of claim 16, wherein the proximal end portion of the outer dome is fixed at the distal end of the base body portion by screwing the outer dome onto the distal end of the base body portion.

18. A microphone, comprising:

a base body portion with a distal end;

a top plate physically coupled to the distal end;

a dome portion mounted at the distal end of the base body portion comprising:

an outer dome with a first set of pillars, an inner dome with a second set of pillars, wherein the first set of pillars are angularly offset from the second set of pillars, and wherein the outer and inner domes comprise plastic material;

a microphone located within the dome portion;

an radio frequency (RF) antenna located within the dome portion; and a reflection cone physically coupled to the top plate configured to reflect sound.

19. The microphone of claim 18, further comprises:

a foam body located within the inner dome, wherein a number of the outer pillars and the inner pillars is the same.

* * * * *